United States Patent [19]

Stubbs, Jr.

[11] 4,037,748

[45] July 26, 1977

[54] CONTAINER AND CLOSURE

[75] Inventor: Edgar S. Stubbs, Jr., Guaynabo, P.R.

[73] Assignee: Rigid-Pak Corporation, Bayamon, P.R.

[21] Appl. No.: 655,481

[22] Filed: Feb. 5, 1976

[51] Int. Cl.[2] ..... B65D 41/32

[52] U.S. Cl. ..... 215/256; 220/270; 220/306; 215/320

[58] Field of Search ..... 220/266, 270, 306; 215/253, 254, 256, 320, 224

[56] References Cited

U.S. PATENT DOCUMENTS

| | | | |
|---|---|---|---|
| 3,608,765 | 9/1971 | Faulstich | 215/256 |
| 3,753,511 | 8/1973 | Ruch | 215/320 X |
| 3,979,003 | 9/1976 | Allen | 215/256 |

*Primary Examiner*—George T. Hall
*Attorney, Agent, or Firm*—McAulay, Fields, Fisher & Goldstein

[57] ABSTRACT

A lid has an inverted U-shaped peripheral rim, which rim snaps over the upper edge of a container sidewall. There are three separate sealing zones between the lid and the container. First, the cover portion interior of the snap on rim has a plug fit interference relationship with the interior of the container. Second, the outer leg of the snap on rim has an interference relationship with an outwardly extending sidewall ridge near the upper edge of the container. Third, the outer leg of the snap on rim also has an inwardly facing ridge which snaps over the sidewall ridge and has an interference relationship with the outer surface of the container sidewall. A tear-off strip constitutes the lower portion of the outer leg of the snap on ridge and tears off below the inwardly facing ridge. The lower edge of this tear off strip abuts against a ledge which extends outward from the container sidewall thereby inhibiting tampering with the strip until initial opening is intended. A vertical weakening line adjacent a pull tab on the tear-off strip further inhibits tampering with the tear-off strip.

9 Claims, 6 Drawing Figures

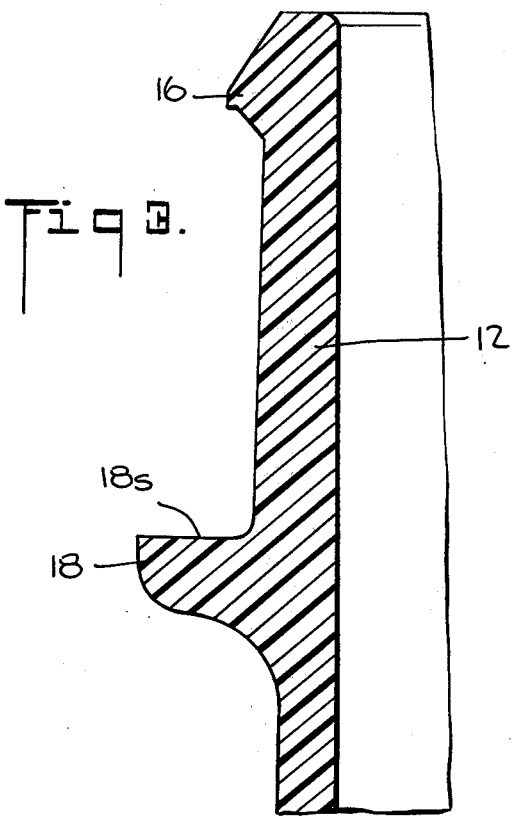
Fig 3.
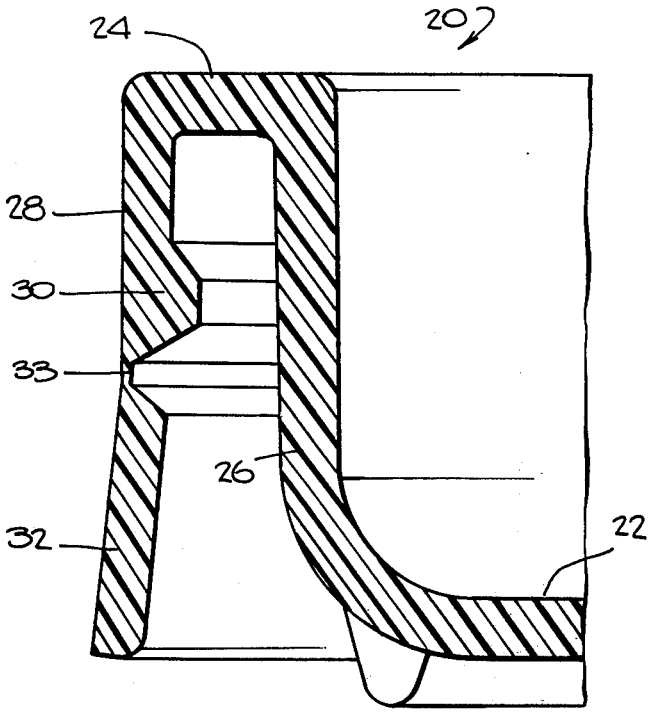
Fig.4.
Fig.5.
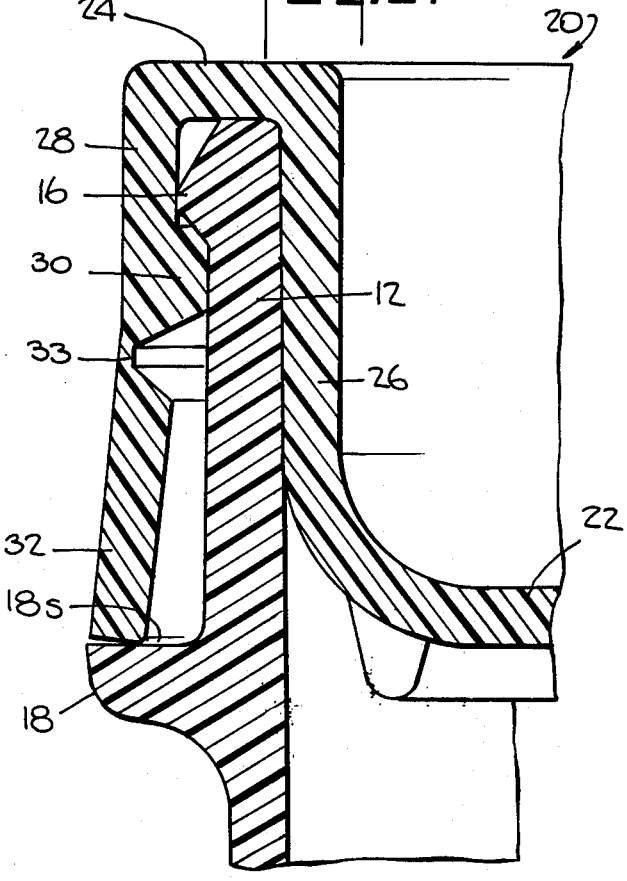
Fig.6.
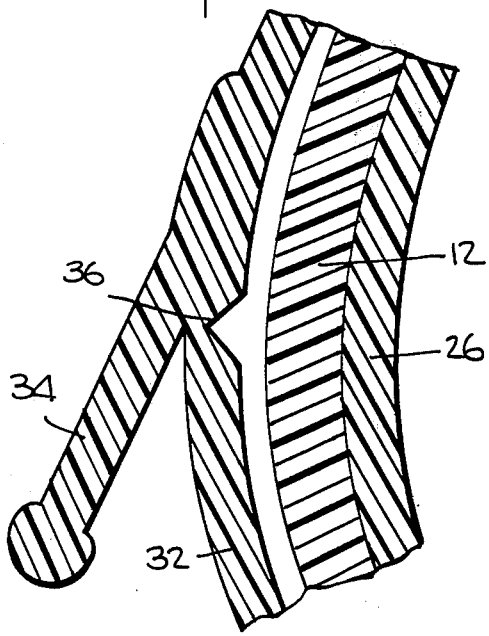

CONTAINER AND CLOSURE

BACKGROUND OF THE INVENTION

This invention relates in general to reusable containers having tight fitting covers and to such containers as are adapted to include a tear-off strip to provide security in that the strip must be removed the first time the container is opened.

There are many container designs intended to serve this reusable function. U.S. Pat. No. 3,753,511 issued on Apr. 21, 1973 to Heinz Ruch discloses a snap-on closure having an inverted U-shaped rim which fits over the rim of the container sidewall to permit resealing of the container after it has been initially opened. This Ruch patent also teaches the use of a tear-off strip at the bottom of the outer leg of the inverted U-shaped rim of the closure. The user can readily determine that the container has initially been opened because the tear-off strip has been either removed or obviously tampered with.

One of the important purposes of this invention is to provide an improved closure or cover in that, when reclosed, the cover will provide an effective seal to keep the contents of the container from being affected by the ambient atmosphere.

It is a related purpose of this invention to provide this seal with a closure that can be manually snapped on and which will then be held on against any tendency to pop open because of air pressure within the container.

It is a further related purpose of this invention to provide such a closure in a design that can incorporate a tear-off strip which will indicate whether or not the container has been initially opened and thus will provide a degree of assurance against premature tampering with the contents of the container.

It is a related purpose of this invention to provide a design which minimizes the risk that the purpose of the tear-off strip can be compromised and thus will minimize the ability of an individual to remove the closure without detaching the tear-off strip.

BRIEF DESCRIPTION

Briefly, one embodiment of this invention is a plastic container with a circular sidewall. The closure that covers the top of the container has an inverted U-shaped rim that fits over the rim of the container sidewall.

The inner leg of the inverted U-shaped rim has an interference fit with the container sidewall so that the plastic cover has a plug fit relationship with the open top of the container. Thus when closure is made, a first sealing zone is provided between the contents of the container and the ambient atmosphere.

At the rim of the container sidewall there is an outwardly extending circumferential ridge which has an interference fit relationship with the outer leg of the inverted U-shaped rim portion of the closure. This provides a second sealing zone and resists any tendency of the closure to be popped off by air under pressure in the container.

In addition, there is an inwardly extending circumferential ridge on the outer leg of the inverted U-shaped closure rim which is positioned to snap over and underlie the outwardly extending ridge on the container sidewall when closure is made. This provides a snap on closure and an interference relationship between the two ridges that further tends to hold the closure on the container against air pressure in the container. Further, this inwardly extending ridge has an interference fit relationship with the outer surface of the container sidewall and thus provides a third sealing zone and further resists any tendency of the closure to pop off.

The container sidewall has an outwardly extending circumferential ledge spaced below the outwardly extending ridge. A circumferential tear-off strip constitutes the lower portion of the outer leg of the inverted U-shaped closure rim. In the closed state, the bottom edge of this tear-off strip abuts against the ledge thereby making it difficult to remove the cover without first removing the tear-off strip. A tab on the tear-off strip permits ready removal of the strip. A weakened vertical line adjacent the tab causes an initial break in the tear-off strip if someone attempts to use the tab to push off the cover without first removing the tear-off strip.

BRIEF DESCRIPTION OF THE DRAWINGS

FIG. 3 is a radial cross sectional view of the upper portion of the container sidewall in the open state.

FIG. 4 is a radial cross sectional view of the outer portion of the closure in the open state showing, in particular, the inverted U-shaped rim.

FIG. 5 is a radial cross sectional view illustrating the closed state of the FIG. 4 closure on the FIG. 3 sidewall.

FIG. 6 is a section along the line 6—6 in FIG. 2 illustrating a vertical weakened line near the tab of the tear-off strip.

FIGS. 3,4,5 and 6 are to a larger scale than are FIGS. 1 and 2.

DESCRIPTION OF THE PREFERRED EMBODIMENTS

Figure 1:
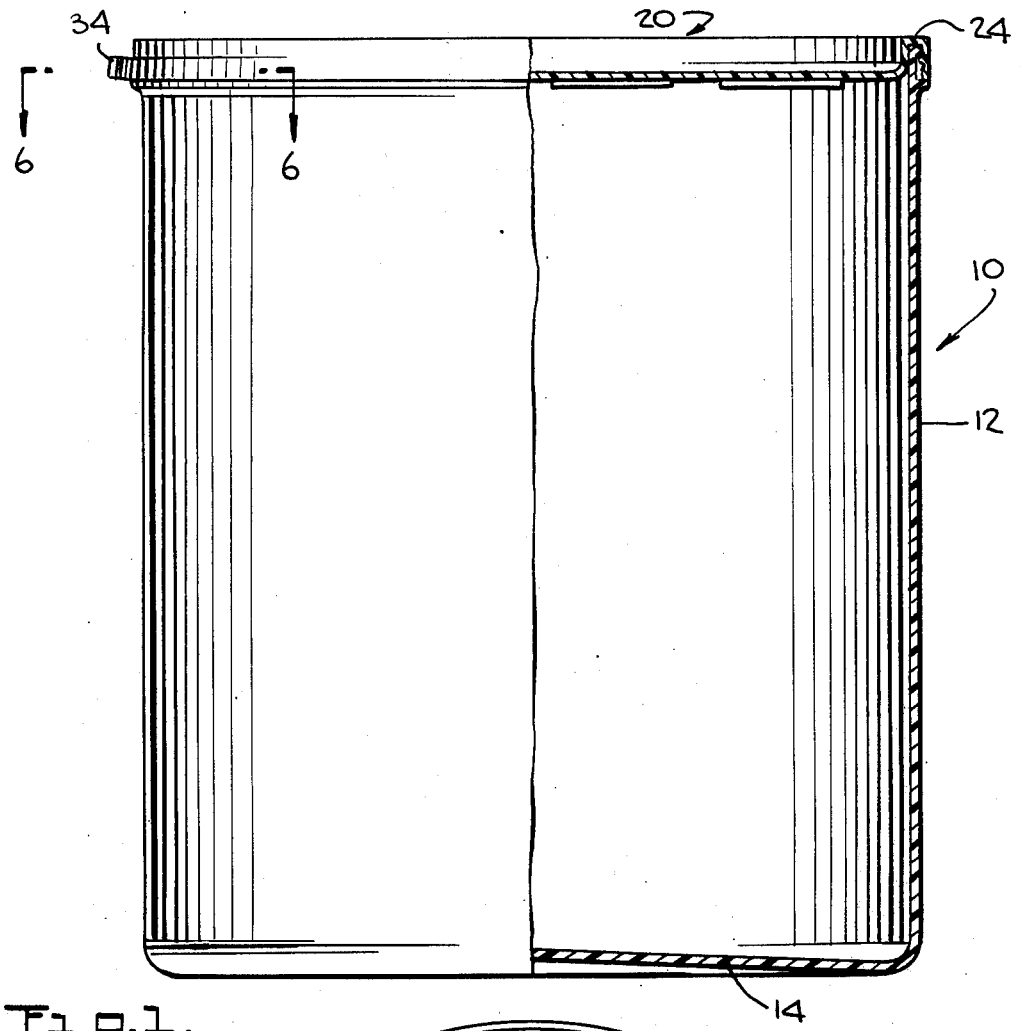
FIG. 1 is a front view in partial elevation and partial cross section of the container with the closure assembled thereon in the closed state.
Figure 2:
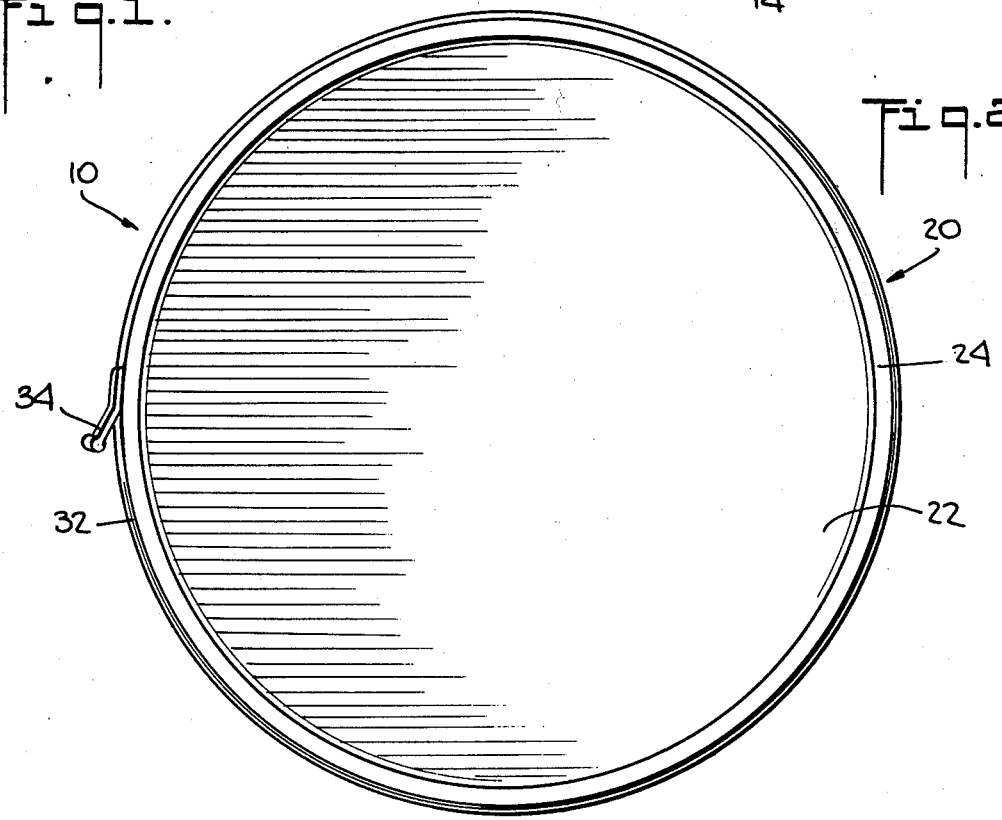
FIG. 2 is a plan view of the FIG. 1 arrangement.

All of the FIGS. show the same embodiment.

The plastic container 10 is essentially cylindrical although, in one embodiment, sidewall 12 flares outwardly slightly at a 1° angle with the vertical, so that the diameter at the bottom of the container is slightly less than the diameter at the top of the container. This facilitates stacking the container on top of one another. The base wall 14 is slightly concave to provide improved container stability. The base 14 is preferably joined to the sidewall 12 with a large radius in order to optimize container strength.

As may best be seen in FIG. 3, a circumferential outwardly extending ridge 16 is positioned close to the upper edge of the sidewall 12. Spaced below this ridge is a circumferential outwardly extending ledge 18 having a horizontal upwardly facing ledge surface 18s. As can better be understood after a description of the cover 12, this sidewall ridge 16 provides an engaging surface and an interference frictional fit with the cover to aid in keeping the cover in the closed state when closure is made. The ledge 18 provides increased assurance that the contents of the container cannot be reached without breaking or removing the tear-off strip.

The cover 20 has a recessed center area 22 which provides closure across the mouth of the container 10. A circumferential inverted U-shaped rim 24 around this center area provides the desired sealing and security. This rim 24 has a circumferential inner leg 26 and a circumferential outer leg 28.

The inner leg 26 extends up from the center area 22 so that when closure is made, the center area 22 is recessed below the upper edge of the container sidewall 12. The outer diameter of this inner leg 26 is a few thousands of an inch greater than the inner diameter of the container sidewall near the upper edge of the sidewall. Thus there is a slight interference fit between the inner leg 26 and the sidewall 12. This provides a plug fit between the closure 20 and the container 10 to effect a first sealing of the contents of the container from the atmosphere when the container and closure are in the closed state shown in FIG. 5.

The outer leg 28 of this inverted U-shaped sealing rim 24, includes an inwardly projecting circumferential ridge 30. When closure is effected, this ridge 30 rides over and under the sidewall ridge 16 thereby providing a snap on closure. In the closed state, the ridge 28 underlies the ridge 16 and thereby provides interference between ridges 16 and 30 that resists opening of the cover. The material out of which both the container 10 and the cover 20 are made is a resilient plastic material so that the outer leg 28 will flex sufficiently to permit removing the cover 20 and reclosing the cover 20.

The outer diameter of the sidewall ridge 16 is slightly greater than the inner diameter of the outer leg 28 in the zone above the ridge 30. Thus, in the closed state, there is an interference fit between outer leg 28 and ridge 16 to effect a second sealing zone that not only protects the contents of the container from communication with the atmosphere but also provides additional gripping power to resist having the cover 20 pop off spontaneously under the pressure of air within the container 10. This is particularly important when one considers that the closure is a plug type of closure that tends to cause some compression of the air within the container after full sealing is affected during closure. In one embodiment this interference fit between outer leg 28 and ridge 16 is in the range of ten thousands of an inch (0.010 inches).

Further sealing and further resistence to having the cover spontaneously pop off is provided by having an interference fit between the ridge 30 on the outer leg and the sidewall 12 of the container. In particular, in one embodiment, the inner diameter of the ridge 30 is about 8 mils (0.008 inches) less than the outer diameter of the adjacent container wall 12.

It has been found that the combination of the interference fit between inner leg 26 and sidewall 12, together with the inteference fit between ridge 16 and outer leg 28, in further combination with the interference fit between ridge 30 and container wall 12 provides a particularly effective seal and provides a high degree of assurance that once closure is effected, closure and sealing will be maintained throughout a wide range of conditions to which the container may be subjected.

The lower portion of the outer leg 28 constitutes the tear-off strip 32. A circumferential notch 33 below the ridge 30 and along the inner surface of the leg 28 provides a weakening line that permits ready removal of the tear-off strip 32 when initially opening the container. A projecting tab 34 is attached to the tear-off strip 32 so that the strip 32 can be readily removed.

The length of the outer leg 28 to the bottom edge of the tear-off strip 32 is such as to result in the bottom edge of the tear-off strip 32 abutting the ledge surface 18*s* when the cover 20 is closed. It thus becomes very difficult to remove the cover 20 without first removing the tear-off strip 38. To prevent compromising the closure by having someone attempt to push the cover up through the tab 34 without removing the tear-off strip, a further notch 36 provides a vertical weakening line through the tear-off strip 32 which will break on manipulation of the tab 34.

In one embodiment where the container 20 has an open mouth of approximately 5 inches in diameter and a height of nearly six inches, the following dimensions are held in order to provide the various interference relationships disclosed above.

The plug fit is attained with an inner leg 26 that has an outer diameter of 4.996 inches. The inner diameter of the container wall 12 at its upper edge is 5.006 inches. But at a distance of 0.35 inches down from the upper edge, the inner diameter of the container sidewall 12 is 4.994 inches. Since the inner leg 26 extends down the inner surface of the sidewall 12 by close to $\frac{3}{8}$ of an inch, there is an interference fit relationship of about 1 mil (0.001 inches) on a radius and about two mils on a diameter over a length of close to 20 mils of the inner leg 26.

With respect to the interference relationship between the ridge 16 and the outer leg 28, the inner diameter of the outer leg 28 in the area above the ridge 30 is 5.134 inches while the outer diameter of the ridge 16 at its greatest extension is 5.144 inches. Thus over a short distance, there is an interference fit relationship of approximately 5 mils on a radius and 10 mils on a diameter.

With respect to the interference relationship between ridge 30 and the container sidewall 12, the inner diameter of the ridge 30 is 5.094 inches while the outer diameter of the container is at that height from the ground is 5.102 inches. Thus there is an interference relationship of 4 mils on a radius and 8 mils on a diameter.

An embodiment of the invention has been disclosed in which the container has an essentially circular sidewall. It should be understood that the invention could be applied to other shaped containers and in particular to a container having a rectangular type of cross section with four sidewalls. It should be understood herein, therefore, that the term circumferential refers to the entire circumference of whatever shape container embodies the invention.

By virtue of the above design, a container and reusable enclosure is provided which is initially substantially tamper proof and once opened can be reclosed a number of times while providing an effective seal to prevent communication between the interior of the container and the ambient atmosphere and to resist tendencies for the closure to pop off when, for example, the atmosphere in the container exerts pressure tending to cause spontaneous opening of the closure.

What is claimed is:

1. A container and closure therefor comprising:

a container having a base, a sidewall and open top, said sidewall having inner and outer surfaces, a snap-on closure to cover said top and be retained on the container, said closure having an inverted circumferential U-shaped rim adapted to fit over the rim of said sidewall, said rim of said closure having a circumferential inner leg and a circumferential outer leg spaced from said inner leg by approximately the thickness of said sidewall of said container, said inner leg of said closure having an first interference fit relationship with said inner surface of said sidewall of said container, an outwardly projecting circumferential first ridge on the outer surface of said sidewall of said container and adjacent said open top of said sidewall, said outer leg of said closure having a second interference fit relationship with said first ridge of said sidewall, an inwardly projecting circumferential second ridge on the inner surface of said outer leg of said closure, said outer surface of said sidewall of said container having a third interference fit relationship with said second ridge, said second ridge snapping over said first ridge as said closure is assembled on said container, said second ridge underlying and spaced below said first ridge in the closed state.

2. The container and closure of claim 1 further comprising:

an outwardly projecting circumferential ledge below said first ridge on said outer surface of said sidewall, and a circumferential tear-off strip portion of said outer leg below said second ridge, the lower edge of said tear-off strip abutting said ledge of said container when in the closed state.

3. The container and closure of claim 2 further comprising:

a circumferential notch below said second ridge along the inwardly facing surface of said outer leg, said notch providing the weakening line for removal of said tear-off strip.

4. The container and closure of claim 2 further comprising:

a tab on said tear-off strip to permit ready removal of said strip, and a vertical weakened line along said tear-off strip adjacent said tab.

5. The container and closure of claim 1 wherein:

the magnitude of said first interference fit relationship is substantially less than the magnitude of said second and said third interference fit relationships.

6. The container and closure of claim 5 wherein:

the width of the zone of said first interference fit relationship is substantially greater than the width of the zone of said second and said third interference fit relationships.

7. The container and closure of claim 1 further comprising:

a circumferential tear-off strip portion of said outer leg, said strip extending completely around said rim, an outwardly projecting circumferential ledge on said outer surface of said sidewall, said ledge extending completely around said sidewall, the entire lower edge of said tear-off strip abutting said ledge of said container when in said closed state.

8. The container and closure of claim 5 further comprising:

a circumferential tear-off strip portion of said outer leg, said strip extending completely around said rim, an outwardly projecting circumferential ledge on said outer surface of said sidewall, said ledge extending completely around said sidewall, the entire lower edge of said tear-off strip abutting said ledge of said container when in said closed state.

9. The container and closure of claim 6 further comprising:

a circumferential tear-off strip portion of said outer leg, said strip extending completely around said rim, an outwardly projecting circumferential ledge on said outer surface of said sidewall, said ledge extending completely around said sidewall, the entire lower edge of said tear-off strip abutting said ledge of said container when in said closed state.

* * * * *